United States Patent [19]

Payne et al.

[11] 4,340,130

[45] Jul. 20, 1982

[54] SCAFFOLD FRAME HEADER

[75] Inventors: George E. Payne, Mission Viejo; Richard G. Meehan, Laguna Niguel, both of Calif.

[73] Assignee: Kwikform America, Inc., Fountain Valley, Calif.

[21] Appl. No.: 171,957

[22] Filed: Jul. 24, 1980

[51] Int. Cl.[3] ..... E04G 1/14; E04G 1/15

[52] U.S. Cl. ..... 182/179; 182/119; 182/222

[58] Field of Search ..... 182/178, 179, 222, 223, 182/119, 82; 249/28

[56] References Cited

U.S. PATENT DOCUMENTS

| | | | |
|---|---|---|---|
| 3,179,212 | 4/1965 | Gostling | 189/19 |
| 3,239,188 | 3/1966 | Gostling | 249/210 |
| 3,245,188 | 4/1966 | Evans | 52/638 |
| 3,366,361 | 1/1968 | Gostling | 248/354 |
| 3,420,557 | 1/1969 | Francis et al. | 287/54 |
| 3,438,160 | 4/1966 | Gostling | 52/122 |
| 3,490,189 | 1/1970 | Gostling | 52/648 |
| 3,493,208 | 2/1970 | Sato | 182/179 |
| 4,222,459 | 9/1980 | Hard | 182/179 |

FOREIGN PATENT DOCUMENTS

| | | | |
|---|---|---|---|
| 7708839 | 2/1979 | Sweden | 182/179 |
| 985912 | 3/1965 | United Kingdom . | |
| 985913 | 3/1965 | United Kingdom . | |
| 1180562 | 2/1970 | United Kingdom . | |
| 1338252 | 11/1973 | United Kingdom . | |

*Primary Examiner*—Reinaldo P. Machado
*Attorney, Agent, or Firm*—Knobbe, Martens

[57] ABSTRACT

The scaffold system of this invention includes structures for retaining hollow folded metal planks on scaffold end frames or scaffold side brackets. A plank retaining lug is used to engage the underside of a plank and cooperates with a hold-down shoulder to retain the plank in place. A frame header may use the structures described to retain planks on both sides of an end frame. The frame header may be releasably mounted to a conventional scaffold end frame. Side brackets may be equipped with the structures to retain planks cantilevered from the scaffolding system.

27 Claims, 10 Drawing Figures

SCAFFOLD FRAME HEADER

BACKGROUND OF THE INVENTION

This invention relates generally to the field of scaffolds and pertains more particularly to headers for scaffolds used for supporting planks.

The uses of scaffolding are manifold and thus a prime requirement for a scaffolding system is adaptability to the various tasks. Scaffolds may be used for providing walkways and support for workmen constructing buildings, painting, cleaning, welding, etc. It naturally is important that scaffolds be secure and sturdy so that bystanders and workmen using the scaffolds are protected.

Prior art scaffolds have included scaffold end frames connected by cross braces to form a three dimensional rectangular unit. Typically, a plurality of frames may be interconnected vertically and horizontally to form extensive structures adapted to the particular task at hand.

Scaffolds typically include planks of wooden lumber laid side-by-side and supported on opposite ends by the end frames to provide an elevated walkway. Hooks have sometimes been fixed in the ends of these wooden planks to clip over horizontal braces on the end frames to prevent the planks from disengagement from the end frames.

Usually, however, the planks have simply been made longer than the space between the end frames so that the opposite ends of the planks extend beyond the frames. As a result, adjacent ends of the planks overlie one another at the end frames resulting in an uneven walkway surface. Another disadvantage of such a walkway is that movement of one plank, caused, for example, by simply walking or moving equipment on the plank, may result in movement and vibrations in other planks up and down the row. Also such prior art planks may be accidentally kicked out by a workman or may drop out if the scaffolding moves or expands when stress is applied to it.

These and other disadvantages of the conventional prior art scaffolds have led to the invention of scaffold assemblies employing rectangular, folded hollow metal planks. These scaffold assemblies have typically supported adjacent plank ends on a shelf-like horizontal member integral with the end frames. Such prior art scaffold configurations provide a flat, even walkway but have had the disadvantage of requiring extensive cross-bracing to prevent relative horizontal movement of the end frames so as to insure that the end frames never inadvertently spread far enough apart in the horizontal direction so as to allow the metal planks to become dislodged from the shelf-like horizontal member and fall through.

Prior art scaffold systems have also sometimes included side brackets which are cantilevered from the types of scaffolds and end frames described above. Such side brackets may be used to support planks in the same ways described above.

SUMMARY OF THE INVENTION

This invention involves improved structures for retaining planks on a scaffolding system. The ends of rectangular hollow metal planks are abutted against a vertical rib attached to the horizontal support member. A hold down shoulder is provided to hold at least one plank against the horizontal support member and to prevent that plank from sliding. A plank retaining lug engages the underside of a plank, to both hold down that plank, and to hold that plank in abutting relationship with the vertical rib.

A significant feature of this invention is that the plank retaining structure is adapted to mate with most of the conventional scaffold frames currently in use with the overlapped wood planks. As a result, by employing the present invention, the owner of a prior art frame can obtain all of the advantages of a flat, metal walkway at a fraction of the cost of an entire replacement scaffold system.

Another feature of the invention is that the planks are positively locked in place by the shoulder and lug to prevent the plank from dropping out and from being kicked or otherwise sliding out of the scaffold. As described below, the novel structure of this invention uses the hollow metal planks of the scaffold to provide lateral rigidity.

Besides the advantages noted above, this invention provides a system employing hollow metal planks which is readily and conveniently assembled and disassembled.

As described below, the plank retaining structures of this invention may be used in conjunction with a scaffold frame header on an end frame so that planks on both sides of, and along the end of the end frame, are retained. The plank retaining structures may also be used in conjunction with side brackets used to provide cantilevered support for planks.

These and other features and advantages of my invention will appear more fully from the following description made in conjunction with the accompanying drawings wherein like reference characters refer to the same or similar parts through the several views.

DESCRIPTION OF THE PREFERRED EMBODIMENT

Figure 1:
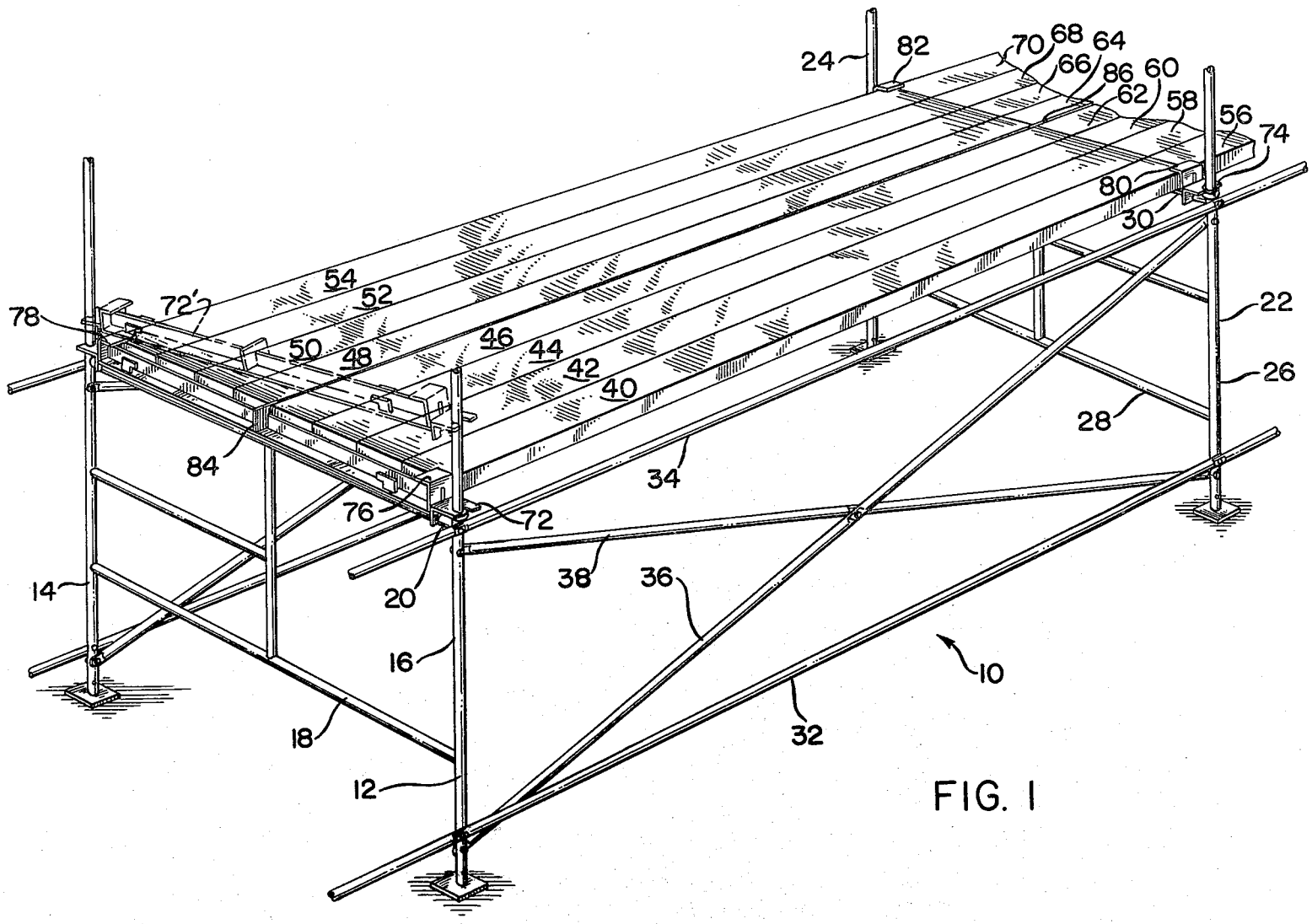
FIG. 1 is a perspective view of a portion of the scaffolding system of this invention; and showing, in phantom, a removable frame header disengaged from an end frame.

Referring first to FIG. 1, scaffold system 10 includes a scaffold end frame 12 having vertical posts 14 and 16 spaced apart horizontally and mechanically connected by horizontal braces 18 and 20. End frame 12 is of the usual, commercially available type which enjoy contemporary uses with overlapping wood planks. It will be understood that the invention is applicable to other conventional scaffold frames including "walk-through" and "arch" type frames. End frame 22 is substantially identical to end frame 12 and includes vertical posts 24 and 26 and horizontal braces 28 and 30. Frame 22 is connected to frame 12 by means of one set of cross braces, including cross braces 32, 34, 36 and 38, extending between and bolted to posts 16 and 26. A second set of crossbraces similar to 32, 34, 36 and 38 extends between and is bolted to posts 14 and 24.

Planks 40, 42, 44, 46, 48, 50, 52, and 54 are substantially identical in construction and lay in a parallel, horizontal, side-by-side arrangement spanning the space between frames 12 and 26 to form a floor for workmen to walk on. Plank 40, as a representative example, is a hollow, elongated, rectangular box formed of welded sheet metal, as known in the prior art. Planks 56, 58, 60, 62, 64, 66, 68 and 70 are substantially identical in construction to plank 40 and extend in a parallel, horizontal, side-by-side arrangement from frame 22 and are parallel to plank 40. Note that planks 40 through 70 are coplanar forming a substantially flat floor having few discontinuities for workmen to trip on.

Frame header 72 is removably mounted on frame 12 to extend horizontally over brace 20 and to engage brace 20 and posts 14 and 16. Frame header 74 is substantially identical in construction to header 72 and is removably mounted on frame 22 to extend horizontally over brace 20 and to engage brace 20 and posts 14 and 16. Headers 72 and 74 support and engage planks 40, 42, 44, 46, 48, 50, 52 and 54.

Plank hold-down shoulders 76 and 78 are mounted on header 72 to hold down planks 40 and 54, respectively. Hold-down shoulder 80 is mounted on header 74 to hold down planks 40 and 56. Hold-down shoulder 82 is mounted on header 74 to hold-down planks 54 and 70. The shoulders 76, 78, 80 and 82 also prevent the respective planks from dislodging or being kicked out by workmen walking on the planks, thus promoting safety.

Divider plate 84 is vertically mounted across the width of header 72 between planks 46 and 48. Divider plate 86 is vertically mounted across the width of header 74 between planks 46 and 48. Plates 84 and 86 allow the use of scaffold system 10 with only a half floor, as when planks 40, 42, 44 and 46 are in place and planks 48, 50, 52 and 54 are omitted. Plates 84 and 86 and shoulders 76 and 80 cooperate to prevent planks 40, 42, 44 and 46 from sliding along the length of headers 72 and 74. Similarly, plates 84 and 86 and clips 78 and 82 cooperate to prevent planks 48, 50, 52 and 54 from sliding along the length of headers 72 and 74. Thus plates 84 and 86 promote safety for workmen using scaffolding system 10 by preventing the planks from dislodging or sliding out.

Frame header 72 is shown in phantom as 72′ wherein it is removed from engagement with frame 12. With the exception of headers 72 and 74 and the items mounted thereto, the individual structures shown in FIG. 1 are commercially available. A significant feature of this invention is that the headers 72 and 74 can be used in combination with commercially available parts to provide a scaffolding system 10 having a uniform, flat walkway which may be disassembled.

FIGS. 2, 3, 4 and 5 illustrate the novel features provided by this invention for locking the planks in position. As shown, frame header 72 includes a plank support 88 advantageously constructed by welding together two angle irons. Plank support 88 is shaped as an elongated, horizontal flat support shelf-like member 90 having a vertical separator rib 92 centered on one side of member 90 and extending along the length of strip 90. The undersides of planks 40, 42, 44 and 46 lie upon and contact strip 90 so that planks 40, 42, 44 and 46 are vertically supported. Planks 40, 42, 44 and 46 abut, but don't necessarily contact, rib 92 so that planks 40, 42, 44 and 46 are prevented from sliding along their lengths.

Plank support 88 has ends 94 and 96 at which shoulders 76 and 78, respectively, are mounted. Shoulder 76 includes a vertical toe plate 98, and a horizontal hold-down plate 100 attached to plate 98, both of which extend across the width of strip 90. Toe plate 98 prevents plank 40 from sliding horizontally off of header 72. Plate 98 cooperates with plate 84 to prevent the sliding of planks along the length of support 88. Hold-down plate 100 prevents plank 40 from lifting vertically off of header 72. Similarly, shoulder 78 includes a vertical toe plate 102 and a horizontal hold-down plate 104.

Frame header 72 further includes plank retainer lugs 106, 108, 110 and 112 which are substantially identical, vertically mounted on strip 90, and spaced away from rib 92. Lugs 106 and 108 are positioned adjacent end 94 and are on opposite sides of rib 92. Lugs 110 and 112 are positioned adjacent end 96 and are on opposite sides of rib 92. Lug 106 includes a prong-supporting tab 114 welded to strip 90. Lug 106 is preferably a single metallic plate further including a prong 116 on tab 114 with prong 116 projecting away from end 94. Prong 116 is spaced away from strip 90 by tab 114.

Frame shoulders 118 and 120 are substantially identical and are attached to plank support 88 adjacent ends 94 and 96, respectively. Shoulder 118 preferably comprises a length of angle iron including a horizontal frame engaging tab 122 having a frame-fitting notch 124 therein. Frame-fitting notch 124 is shaped to reasonably engage post 72 of FIG. 1. Shoulder 118 also includes a vertical frame-engaging tab 126 having a frame-fitting notch 128 therein. Notch 128 is shaped to releasably engage brace 20 of FIG. 1. Scaffold 120 is shaped to engage post 14 and brace 20 of FIG. 1. Shoulders 118 and 120 cooperate to prevent header 72 from falling off of end frame 12 and from rotating on brace 20. Shoulders 118 and 120 also act to transfer forces between frame 12 and planks supported by header 72.

Header 72 includes divider plate 84 vertically mounted across the width of strip 90 transversely to rib 92 and located between the lugs 106 and 108 and the lugs 110 and 112.

Figure 3:
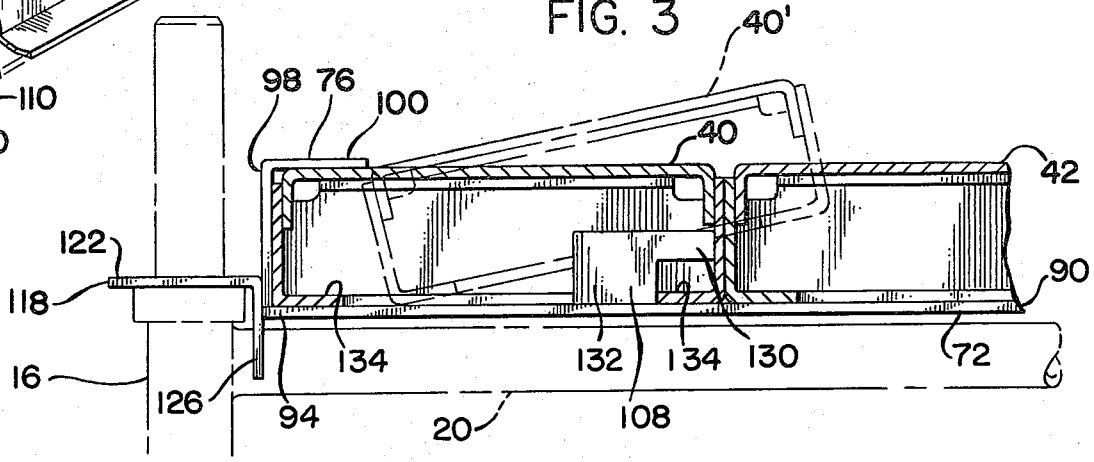
FIG. 3 is partially cut-away side view of the header of FIG. 2 taken along the line 3—3, and showing, in phantom, a portion of the end frame, and further showing, in phantom, a plank disengaged from the header.

As shown in FIG. 3, lug 108 includes a prong 130 on a tab 132. Plank 40 has an open underside with a horizontal flange 134 on the inside periphery of the underside of the plank. Lug 108 mates with and bears against flange 134. Tab 132 prevents plank 40 from sliding along strip 90 towards end 94. Prong 130 overlies flange 134 to prevent plank 40 from being lifted vertically.

The individual planks are assembled on the scaffold by first positioning plank 40′ as shown by dashed lines in FIG. 3. The plank is laid flat on the shelf-like member 90 and then slid into position by a horizontal movement so that the lead edge of the plank 40' abuts with end 94 and positioned underneath hold-down plate 100 of shoulder 76. The same horizontal movement also causes the bottom flange of the metal plank to mate with lug 108.

Figure 2:
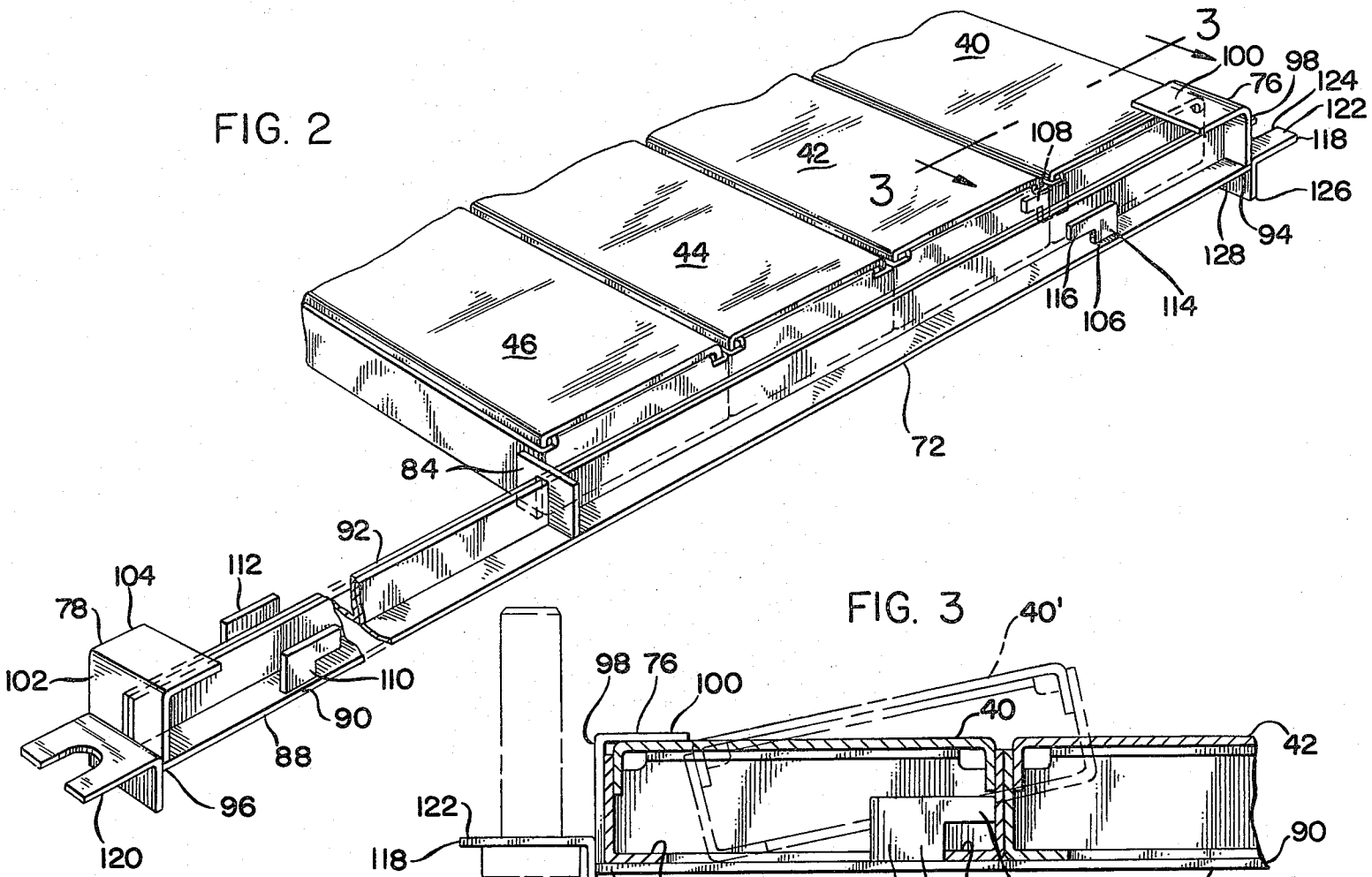
FIG. 2 is a perspective view of a removable scaffold frame header showing planks mounted thereon.

The remaining planks 42, 44 and 46 are then laid side-by-side on the shelf-like member 90. When positioned as shown in FIG. 2 and the solid lines of FIG. 3, both vertical as well as longitudinal and traverse horizontal movement of plank 40 is prevented. As described below, this novel structure not only enables a smooth walkway to be provided on a conventional scaffold but also substantially increases the overall stability of the scaffold.

Removal of the planks is performed in the reverse order with plank 40 being removed last. This is required since as described above and shown in FIG. 3, plank 40 must be slid in a transverse horizontal direction away from end 94 and then lifted from member 90.

Figure 4:
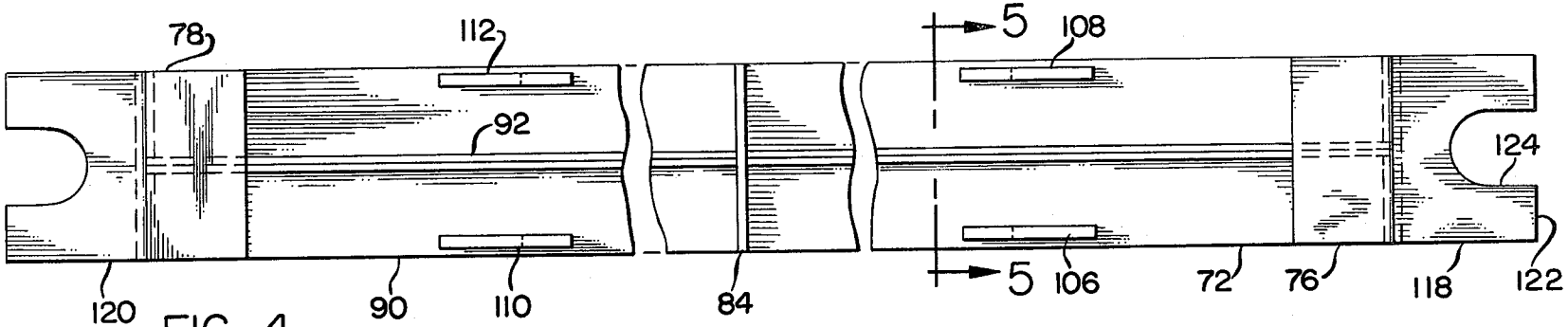
FIG. 4 is a top plan view of a removable scaffold frame header.

FIG. 4 illustrates that header 72 is symmetric about plate 84, and is symmetric about a plane parallel to and cutting through rib 92. This symmetry assures that a scaffolding system will be easy to assemble and that the number of individual parts required will be minimized.

The present invention provides a novel structure for utilizing the hollow metal planks in combination with the frame headers for both substantially increasing the lateral stability of the scaffold and insuring that the planks cannot fall out.

Figure 5:
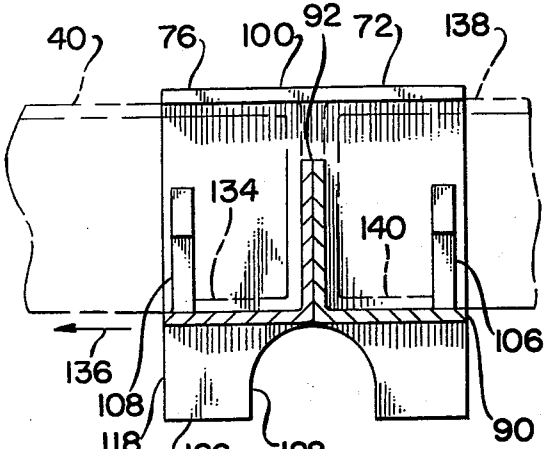
FIG. 5 is a cross-sectional view of the header of FIG. 4 taken along the line 5—5 and showing, in phantom, planks mounted thereon.

As shown in FIG. 5, flange 134 is trapped between rib 92 and lug 108 because of the engagement of lug 108 with the underside of plank 40. Thus, lug 108 may bear against flange 134 or rib 92 so that forces may be transferred between plank 40 and header 72. Similarly, flange 140 of plank 138 (which is substantially identical to plank 40) is trapped between rib 92 and lug 106. Lug 106 may bear against flange 140 or rib 92 so that forces may be transferred between plank 138 and header 72. Thus, the structures shown in FIG. 5 allow the transfer of forces between planks 40 and 138, without necessarily transferring forces to the frame 12 shown in FIG. 1. The combination of planks similar to plank 40, with frame headers, similar to header 72, thus act as load bearing and force transferring members to cooperate with the cross braces, similar to cross braces 32, 34, 36 and 38, of the scaffolding system 10 of FIG. 1.

Force transfer may also occur through header 74, between planks 40 and 56 and between planks 54 and 70 in FIG. 1. Thus the structures of FIG. 5 lend structural support to the scaffolding system 10 in a direction parallel to the lengths of the planks.

Lug 108 also prevents plank 40 from being pulled horizontally away from header 72 along the direction 136 and falling out of the scaffold system 10. Since planks 40 and 54 are similarly trapped in place on headers 72 and 74, the planks 42, 44, 46, 48, 50 and 52 are similarly prevented from falling out of the scaffold system 10 shown in FIG. 1.

The structures of FIG. 5 further lend support so that the frames 12 and 22 of FIG. 1 are prevented from pulling apart horizontally. That is, planks 40 and 54, in cooperation with headers 72 and 74, help to maintain frames 12 and 22 at a constant horizontal separation distance.

The supporting and force transferring functions of planks 40 and 54 and headers 72 and 74 allow cross braces 32, 34, 36 and 38 to be unbolted and removed when it is desired for workmen to have clear access to the space between posts 16 and 26. It may be extremely advantageous in many circumstances to provide a temporary pass-through or workspace in a scaffolding system free of obstructions caused by cross-bracing. It can be seen that in complex, multi-level scaffolding systems, this invention allows cross bracing to be selectively removed in differing areas of the workspace as the task progresses.

Figure 6:
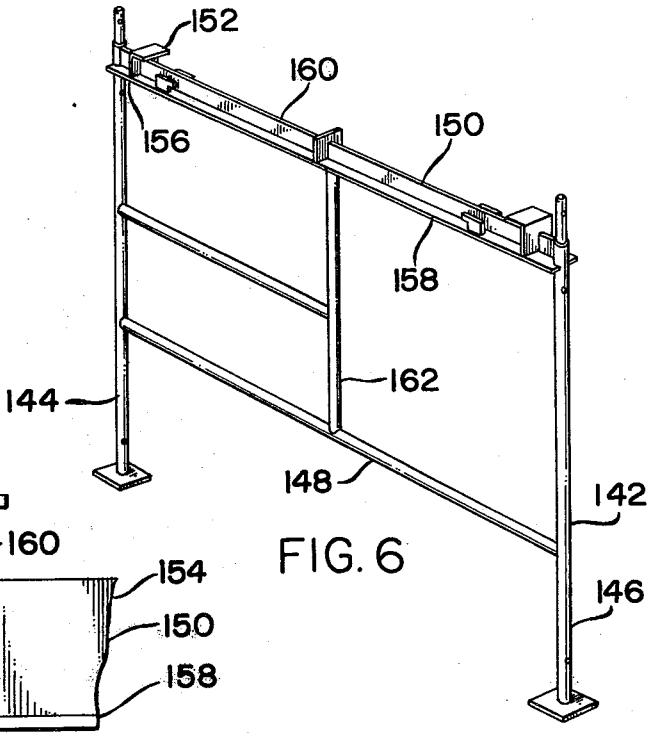
FIG. 6 is a perspective view of an end frame having a scaffold frame header welded thereto.
Figure 7:
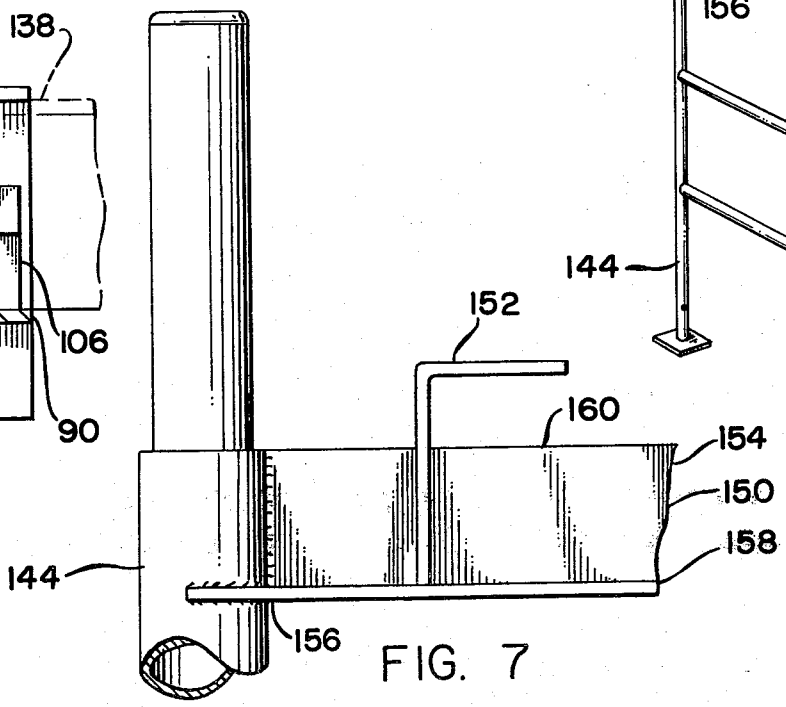
FIG. 7 is a side view of a portion of the end frame of FIG. 6.

An alternative embodiment of this invention is depicted in FIGS. 6 and 7 wherein the novel structure of the invention is formed as an integral part of the entire scaffold assembly. As a result, a brace similar to brace 20 of FIGS. 1 and 3 is not used. End frame 142 has vertical posts 144 and 146 spaced apart horizontally and connected by brace 148. Scaffold frame header 150 extends horizontally between and is welded to posts 144 and 146.

Header 150 is structurally identical to the headers 72 and 74 of FIGS. 1 through 5 excepting that header 150 is adapted to be welded directly on frame 142. Header 150 functions in the same ways as headers 72 and 74 and acts similarly to support planks, to transfer forces, and to provide for structural support for a scaffolding system. Therefore, frame 142 with header 150 performs analogous and interchangeable functions with the frame 12 with header 72 or frame 22 with header 74, shown in FIG 1.

Vertical brace 162 extends between brace 148 and header 150 to provide support to header 150 and to distribute forces through frame 142. Thus, header 150 performs functions analogous to both brace 20 and header 72 of FIGS. 1 through 5.

As shown in FIG. 7, header 150 includes a hold-down shoulder 152 attached to a plank support 154 adjacent an end 156 thereof. Plank support 154 comprises a pair of angle irons welded together and has the shape of a elongated, horizontal, flat, shelf-like support member 158 having a vertical separator rib 160 centered along the length thereof. Both member 158 and rib 160 extend between posts 142 and 144 and both are welded to posts 142 and 144.

Figure 8:
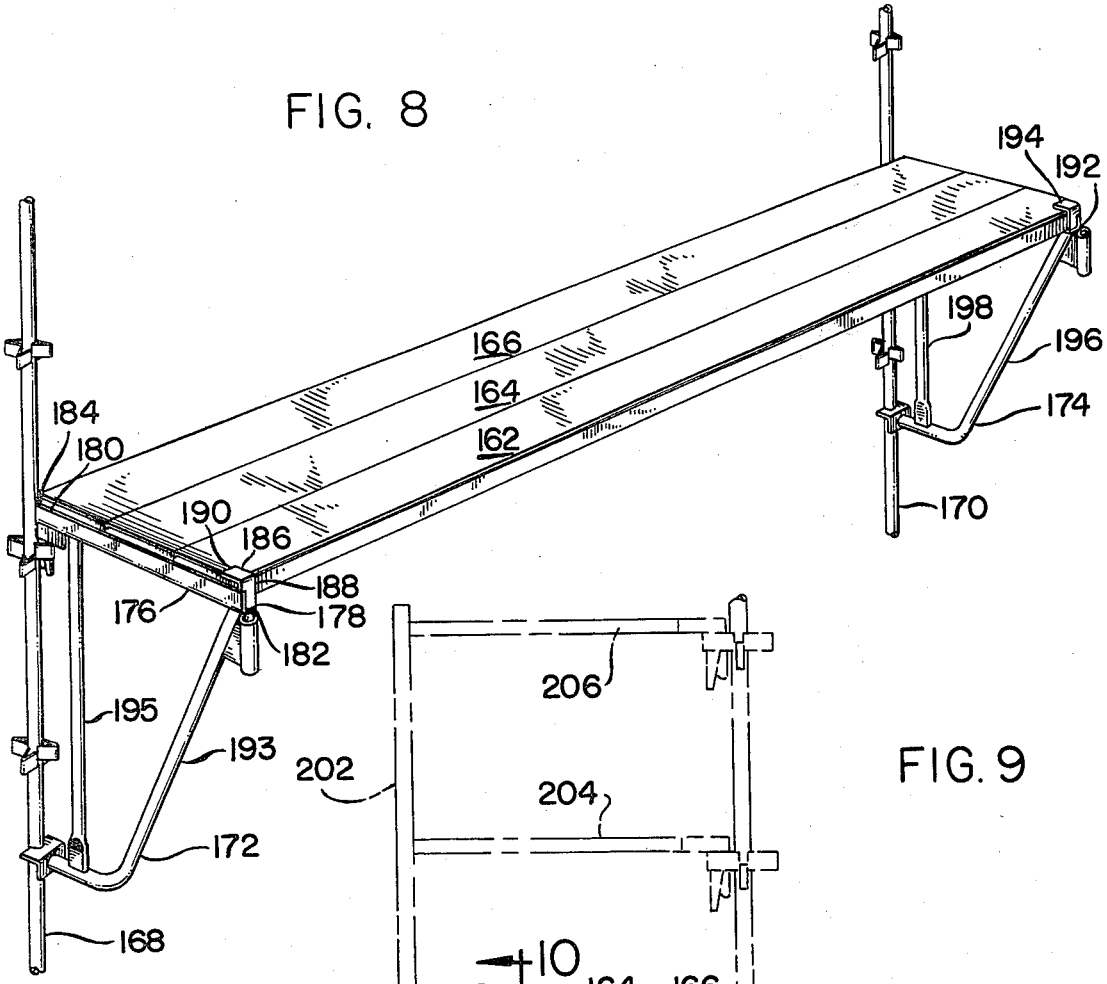
FIG. 8 is a perspective view of a portion of a scaffold system having the side brackets of this invention with planks thereon.
Figure 9:
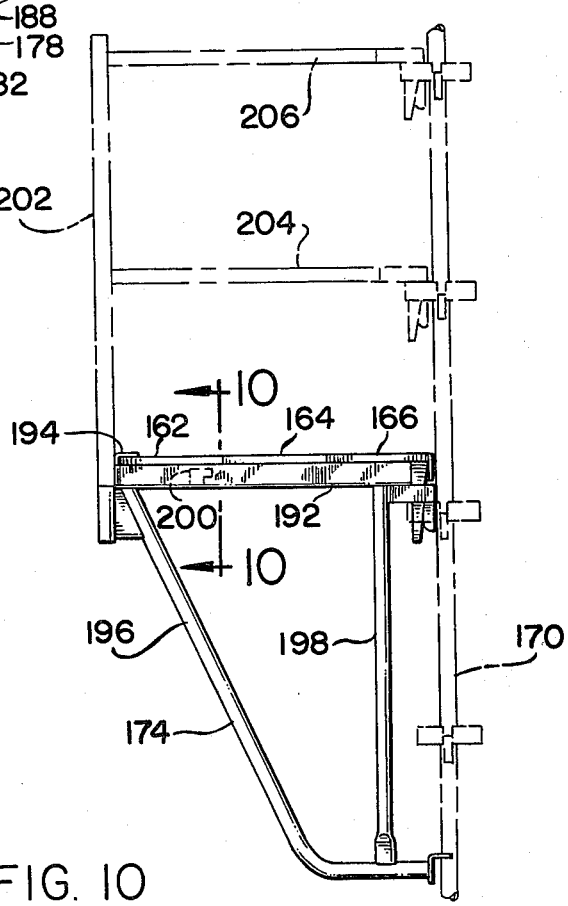
FIG. 9 is an end elevational view of a portion of a scaffold system having a side bracket of this invention with planks thereon.
Figure 10:
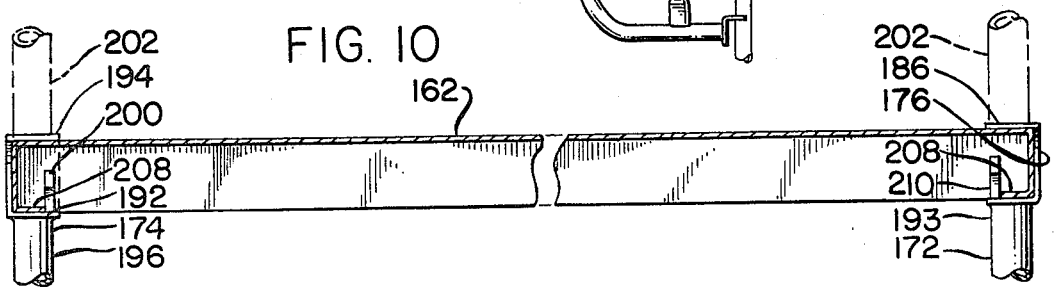
FIG. 10 is an elevational view of a portion of the scaffold system of FIG. 9 taken along the line 10—10.

Side brackets employing certain features of this invention are shown in FIGS. 8, 9 and 10. Planks 162, 164 and 166 are substantially similar hollow metal elongated planks and may be identical to planks 40 through 70 described in conjunction with FIGS. 1 through 5, above. Vertical posts 168 and 170 are part of a scaffolding system and serve to support side brackets 172 and 174, respectively. Brackets 172 and 174 support planks 162, 164, and 166 in a cantilevered fashion.

Side brackets 172 and 174 are similar in construction and are shaped like mirror images of each other. Side bracket 172 includes a generally horizontal plank support 176 preferably comprising a length of angle iron shaped like an elongated, horizontal flat support shelf-like member 178 having a vertical separator rib 180 extending along the length of one edge thereof. Plank support 176 has opposite ends 182 and 184. Plank hold-down shoulder 186 is attached to plank support 176 adjacent end 182, and having a vertical toe plate 188 mounted across the width of member 178, and having a horizontal hold-down plate 190 attached to plate 188 and extending across the width of member 178.

Bracket 172 also includes a transverse brace 193 extending from post 168 to end 182 of plank support 176, and a vertical brace 195 extending from brace 193 to plank support 176, adjacent end 184.

Side bracket 174 includes a plank support 193 having a plank hold-down shoulder 195 mounted thereon. Bracket 174 also includes a transverse brace 196 and a vertical brace 198. Planks 162, 164 and 166 extend horizontally in a side-by-side arrangement between plank supports 176 and 193. Plank 166 lies adjacent posts 168 and 170 so that posts 168 and 170 cooperate with shoulders 186 and 195 to prevent planks 162, 164 and 166 from sliding horizontally along the lengths of supports 176 and 192. Shoulders 186 and 195 also cooperate to prevent plank 162 from being accidentally kicked off of the brackets 172 and 174. Supports 176 and 193 provide vertical support to the undersides of planks 162, 164 and 166; and further act to prevent horizontal sliding of planks 162, 164 and 166 along the lengths thereof.

As shown in FIG. 9, plank support 193 has plank retainer lug 200 (shown in phantom) vertically mounted thereon adjacent shoulder 195. The structure of lug 200 is the same as the structure of lug 106 as described above in relation to FIG. 2. Lug 200 cooperates with shoulder 195 to prevent plank 162 from being lifted vertically or slid horizontally towards shoulder 195. Lug 200 releasably engages the underside of plank 162. With planks 164 and 166 in place on support 195, plank 162 is locked or trapped in place relative to support 195.

As is typical in the prior art, guard posts 202, guard rails 204, and hand rails 206 may be attached to posts 168 and 170 and brackets 172 and 174 to complete a cantilevered work platform having planks 162, 164 and 166 as a floor.

Referring to FIG. 10, lip 208 on the inside periphery of plank 162 is trapped between lug 200 and support 193. Lip 208 is also trapped between support 176 and lug 210 on support 176. Lug 210 is substantially identical to lug 200 and functions similarly. Lugs 200 and 210 may bear against flange 208 and thus prevent brackets 172 and 174 from pulling apart horizontally or pivoting about posts 168 or 170. Lugs 200 or 210 further cooperate with supports 176 and 193 to prevent plank 162 from sliding horizontally, along its length, away from supports 176 or 193.

What is claimed is:

1. An assembly for converting a conventional scaffold mounting overlapping wood planks to a scaffold supporting plural hollow folded metal planks so that their adjacent juxtaposed ends are in the same plane to provide an even walkway surface comprising:

plank support means for providing an elongated shelf-like member for supporting the ends of said folded metal planks;

means for releasably mounting said plank support means to a conventional scaffold;

a plank hold-device shoulder, attached to said shelf-like member restraining one of said planks from vertical movement and transverse horizontal movement; and a plank retainer lug vertically mounted on said shelf-like member for engaging a flange of said one plank for preventing longitudinal horizontal movement of said one plank relative to said plank support means so that said conventional scaffold is prevented from pulling away from said hollow folded metal planks mounted on said plank support means, said lug preventing upward vertical movement of said one plank.

2. The assembly of claim 1 comprising:

a vertical separator rib centered on and extending the length of said plank support means, and said plank support means having first and second plank support ends;

first and second of said plank hold-down shoulders attached to said shelf-like member adjacent said first and second support ends, respectively, and each of said hold-down shoulders having a vertical toe plate mounted across the width of said shelf-like member and having a horizontal hold-down plate attached to said toe plate and extending across the width of said shelf-like member; and first and second sets of said plank retainer lugs vertically mounted on said shelf-like member so that each set of said lugs is positioned adjacent said first and second support ends, respectively, and so that in each set os said lugs, said lugs are positioned on opposite sides of said separator rib.

3. The assembly of claim 2 wherein said means for releasably mounting said plank support means to a conventional scaffold comprising a horizontal frame-engaging tab having a frame-fitting notch therein and a vertical frame-engaging tab having a frame-fitting notch therein for preventing said plank support means from falling off said scaffold and from rotating relative thereto.

4. The assembly of claim 2 comprising:

a vertical divider plate mounted across the width of said shelf-like member transversely to said separator rib and located along the length of said member intermediate said first and second sets of plank retainer lugs.

5. The assembly of claims 1, 2 or 4 wherein said plank retainer lug includes a generally horizontal projection engaging a flange of one of said planks for further restraining upward vertical movement of said plank relative to the scaffold.

6. The assembly of claims 2 and 4 wherein each of said plank retainer lugs comprises:

a horizontal plank-engaging prong parallel to the length of said shelf-like member; and a vertical prong supporting tab attached to said prong and to said shelf-like member, so that said prong is spaced from said member, and so that said plank retainer lug is spaced away from said separator rib.

7. In a scaffold frame having at least two vertical posts spaced apart horizontally and mechanically connected by at least one brace, wherein the improvement comprises:

a plank support including an elongated, horizontal flat support member with a vertical separator rib centered on the upper side of said plank support and extending along the length of said support member and said plank support having first and second plank support ends attached to said vertical posts so that said plank support spans the distance between said vertical posts;

first and second plank hold-down shoulders attached to said plank support adjacent said first and second support ends, respectively, and each of said hold-down shoulders having a vertical toe plate mounted across the width of said support member and having a horizontal hold-down plate attached to said toe plate and extending across the width of said support member; and first and second sets of plank retainer lugs vertically mounted on said support member so that each set of said lugs is positioned adjacent said first and second support ends, respectively, and so that in each set of said lugs, said lugs are positioned on opposite sides of said separator rib, each said lug preventing the upward vertical movement of at least one of said planks.

8. The scaffold frame of claim 7 further comprising:

a vertical divider plate mounted across the width of said support member transversely to said separator rib and located along the length of said plank support intermediate said first and second sets of plank retainer lugs.

9. The scaffold frame of claims 7 and 8 wherein each of said plank retainer lugs comprises:

a horizontal plank-engaging prong parallel to the length of said plank support;

a vertical prong supporting tab attached to said support member; so that said prong is spaced away from said support member, and so that said plank retainer lug is spaced away from said separator rib.

10. A scaffold side bracket comprising:

a plank support including an elongated, horizontal flat support member with a vertical separator rib on one edge of the upper side of said support strip and extending along the length of said support member, and said plank support having first and second plank support ends;

a plank hold-down shoulder attached to said plank support adjacent said first support end, said hold-down shoulder having a vertical toe plate mounted across the width of said support member and having a horizontal hold-down plate attached to said toe plate and extending across the width of said support member; and a plank retainer lug vertically mounted on said support strip adjacent said first end for preventing the vertical movement of one of said planks.

11. The scaffold side bracket of claim 10 wherein said plank retainer lug comprises:

a horizontal plank-engaging prong parallel to the length of said plank support; and a vertical prong supporting tab attached to said support strips, so that said prong is spaced away from said separator rib.

12. A scaffold plank supporting member comprising:

means for supporting a plurality of substantially similar, elongated planks in vertical position by supplying support to the undersides thereof;

means for restraining said planks in horizontal position in a parallel arrangement by supplying restraint to the ends thereof;

means for holding at least one of said planks down by holding down the upper side of said one plank; and means on said supporting means for retaining said one plank horizontally by engaging the underside of said one plank.

13. The scaffold plank supporting member of claim 12 wherein said retaining means is further for holding-down said one plank vertically and for cooperating with said supporting means for retaining said one plank in vertical position.

14. The scaffold plank supporting member of claim 13 further comprising:

means for forcing said planks into side-by-side contact and thereby acting in cooperation with said holding means and said retaining means to lock said one plank in place.

15. The scaffold plank supporting member of claim 14 further comprising:

means for releasably mounting said plank supporting member on a scaffold frame.

16. The scaffold plank supporting member of claim 14 wherein said mounting means comprises a plurality of frame-engaging tabs with frame-fitting notches.

17. The scaffold plank supporting member of claim 12 wherein said support means includes a horizontal, flat support member; said restraining means includes a vertical separator rib on said support member; said holding means includes a shoulder attached to said support strip; and said retaining means includes a lug vertically mounted on said support member.

18. The scaffold plank supporting member of claim 14 wherein said forcing means comprises a divider plate parallel to said planks for forceably contacting a side of said planks so that said one plank is forceably locked in place.

19. A scaffolding system comprising:

a plurality of scaffold frames each consisting of at least two vertical posts spaced apart horizontally and mechanically connected by at least one brace;

a plurality of substantially similar, elongated planks for extending between pairs of said scaffold frames;

a plurality of frame headers, each horizontally mounted on separate ones of said scaffold frames for supporting said planks, and each of said frame headers including plank retainer lugs for engaging the undersides of said planks so that said scaffold frames are prevented from pulling apart in a horizontal direction along the length of said planks and so that said planks are prevented from lifting up.

20. The scaffolding system of claim 19 wherein each of said planks comprises a hollow, elongated, rectangular box with an open underside with a flange on the inside periphery thereof, so that said retainer lugs mate with and bear against said flange.

21. The scaffolding system of claim 20 wherein each of said retainer lugs comprises:

a horizontal plank engaging prong for extending inside one of said planks and for overlying said flange to prevent said plank from being lifted vertically; and a vertical prong supporting tab attached to said prong for bearing against said flange to prevent said plank from sliding horizontally along its length.

22. A scaffolding system comprising:

at least two scaffold side brackets;

a plurality of substantially similar, elongated planks for extending between pairs of said scaffold side brackets; and said side brackets including plank retainer lugs for engaging the undersides of said planks so that said side brackets are prevented from pulling apart in a horizontal direction along the length of said planks and so that said planks are prevented from lifting up.

23. The scaffolding system of claim 22 wherein each of said planks comprise a hollow, elongated, rectangular box with an open underside with a flange on the inside periphery thereof, so that said retainer lugs mate with and bear against said flange.

24. The scaffolding system of claim 23 wherein each of said retainer lugs comprises:

a horizontal plank engaging prong for extending inside one of said planks and for overlying said flange to prevent said plank from being lifted vertically; and a vertical prong supporting tab attached to said prong for bearing against said flange to prevent said plank from sliding horizontally along its length.

25. A scaffolding system, comprising:

at least one pair of upright scaffold frames spaced apart from one another;

a plurality of elongated planks extending between said pair of scaffold frames, said planks comprising a pair of side planks located at each end of each one of said scaffold frames;

at least one pair of frame headers, each of said frame headers being mounted on separate ones of said scaffold frames, each said frame header comprising:

means on said frame header for supporting said planks in a vertical position, said supporting means restraining said planks from moving in a longitudinal direction;

a pair of hold-down device shoulders near each end of said frame header, each said shoulder restraining one of said side planks from vertical movement and from horizontal transverse movement; and a pair of plank retainer lugs on said supporting means spaced from one end of said plank hold-down device shoulder, each said lug engaging one of said side planks and preventing longitudinal movement of said one of said side planks relative to said supporting means so that said scaffold frame is prevented from pulling away from said one of said side planks in order to maintain said pair of scaffold frames in said upright, spaced relation.

26. A frame header for supporting planks of a scaffolding system, comprising:

means for supporting a plurality of said planks in a substantially horizontal position by supplying support to the underside of said planks, said planks comprising a pair of side planks located near each end of said supporting means;

a pair of hold-down devices on said supporting means, each said hold-down device restraining one of said side planks from vertical movement and from horizontal transverse movement; and a pair of lugs on said supporting means, each said lug located relative to one of said hold-down devices to permit engagement of one of said side planks with said hold-down device, said lugs engaging said side planks and preventing the longitudinal movement of said side planks relative to said supporting means so that said supporting means is prevented from pulling away from said side planks.

27. A scaffold plank supporting member, comprising:

means for supporting a plurality of elongated scaffold planks in substantially horizontal position by supplying support to the underside of said planks, said planks comprising at least one side plank;

means on said supporting means for holding said side plank down, said hold-down means restraining said side plank from vertical movement; and means on said supporting means engaging said side plank for preventing the longitudinal movement of said side plank relative to said supporting means so that said supporting means is prevented from pulling away from said side plank, said engaging means located relative to said hold-down means to permit engagement of said side plank with said hold-down means.

* * * * *